US007607373B2

(12) United States Patent
Anderson

(10) Patent No.: US 7,607,373 B2
(45) Date of Patent: Oct. 27, 2009

(54) ADJUSTING DEVICE FOR A HAND-HELD TOOL

(75) Inventor: Dwain Anderson, Howick (CA)

(73) Assignee: Francis International Inc., Montreal (Qc) (CA)

( * ) Notice: Subject to any disclaimer, the term of this patent is extended or adjusted under 35 U.S.C. 154(b) by 0 days.

(21) Appl. No.: 12/153,732

(22) Filed: May 23, 2008

(65) Prior Publication Data

US 2008/0289452 A1 Nov. 27, 2008

Related U.S. Application Data

(63) Continuation-in-part of application No. 11/802,600, filed on May 24, 2007, now abandoned.

(51) Int. Cl.
*B25B 13/12* (2006.01)
*B25B 13/00* (2006.01)
*B25B 7/00* (2006.01)

(52) U.S. Cl. ..... 81/129; 81/57.44; 81/301

(58) Field of Classification Search ..... 81/129, 81/301, 179, 176.3, 125.1, 57.44
See application file for complete search history.

(56) References Cited

U.S. PATENT DOCUMENTS

| | | | | |
|---|---|---|---|---|
| 1,271,365 | A * | 7/1918 | Reynolds, Jr. | 81/129 |
| 1,675,979 | A * | 7/1928 | Laird | 251/148 |
| 4,031,619 | A | 6/1977 | Gregory | |
| 4,351,097 | A * | 9/1982 | Hashimoto et al. | 81/301 |
| 4,492,106 | A * | 1/1985 | Amighini | 81/301 |
| 4,689,957 | A | 9/1987 | Gallentine | |
| 4,957,021 | A | 9/1990 | Helton | |
| 5,113,679 | A * | 5/1992 | Ferraro et al. | 72/21.1 |
| 6,973,857 | B1 | 12/2005 | Anderson | |

* cited by examiner

*Primary Examiner*—Hadi Shakeri
(74) *Attorney, Agent, or Firm*—Equinox Protection; Franz Bonsang, Patent Agent

(57) ABSTRACT

A hand tool device incorporates a fluid operated mechanism actuable by a plunger pressurizing a reservoir to force fluid past a resiliently biased valve to a fluid filled cylinder accommodating a piston carrying a contact member for clamping a work piece in the manner of an adjustable wrench or pliers. Continued operation of the plunger increases the pressure applied to the work piece.

15 Claims, 9 Drawing Sheets

ADJUSTING DEVICE FOR A HAND-HELD TOOL

CROSS REFERENCE TO RELATED APPLICATION

The present invention is a Continuation-In-Part of U.S. patent application Ser. No. 11/802,600 filed on May 24, 2007, now abandoned, and which is incorporated herein by reference. Benefit of U.S. Provisional Application for Patent Ser. No. 60/960,713 filed on Oct. 11, 2007, is hereby claimed.

FIELD OF THE INVENTION

The present invention relates to hand tool devices, and is more particularly concerned with an adjusting device for hand-held tools, for example wrenches and the like, for applying torque to fixtures or work pieces, such as nuts and bolts.

BACKGROUND OF THE INVENTION

In my U.S. Pat. No. 6,973,857 I describe such a hand tool device which incorporates fluid operable contact members which is moveable into alternate clamping positions in relation to a work piece by the actuation of a button. The contact members are carried by pistons sliding within opposed cylinders having at their full bore ends resiliently loaded ball valves. When it is desired to effect clamping action by one of the contact members in relation to a work piece, the button is depressed and in so doing the valves are unseated since being physically pushed by the stem of the button thus allowing fluid to eventually flow between the cylinders. By manually pushing the other contact member, fluid flow occurs such that the piston of the contact member associated with the work piece is forced along its cylinder to extend the contact member into the desired clamping position. Release of the button allows the valves to reseat and to lock the contact members in position.

Whilst the hand tool device of this prior art functions adequately well, it has been found in practice that the resilient loading of the button can deteriorate with time occasioning response delay thus causing somewhat inefficient operation of the tool and not providing the positive instantaneous action required. Furthermore, it requires two-handed operation and manual effort in addition to the fluid, e.g. hydraulic, force applied to the contact member.

Accordingly, there is a need for an improved adjusting device for hand-held tools.

SUMMARY OF THE INVENTION

It is therefore a general object of the present invention to provide an improved adjusting device for hand-held tools.

An advantage of the present invention is that the adjusting device obviates the need for dual-handed operation.

Another advantage of the present invention is that the adjusting device enables the user to apply added clamping pressure single-handedly to a contact member in contact with a work piece.

A further advantage of the present invention is that the adjusting device facilitates release of the clamping pressure when desired to disengage the contact member from the work piece.

Yet a further advantage of the present invention is that the adjusting device provides a simple and effective means of switching the clamping action from one end to another of a hand tool device with the use of one actuating member.

Still a further advantage of the present invention is that the piston of the adjusting device can be used to displace a pivotable and/or slidable contact member for clamping or holding a work piece therewith, such as in pliers and the like, or an open-face wrench or any other type of hand tools.

A further object of the present invention is to provide a hand tool device which affords positive actuation of the valving to open and close the same.

A still further object of the present invention is to provide a hand tool device that has a clamping jaw.

Another object of the present invention is to provide a plurality of jaws of varying shapes and sizes that are interchangeable dependent upon the use of the hand held tool.

According to an aspect of the present invention, there is provided an adjusting device for a hand-held tool, comprising: a body defining at least one fluid-filled cylinder internally thereof; a piston movable within said cylinder and carrying a contact member extending exteriorly from the cylinder for contact in use with a work piece to be retained by the tool; a fluid reservoir in communication with said cylinder; a valve interposed between said reservoir and the cylinder for the control of fluid to and from the cylinder; and an actuating member associated with the fluid reservoir for initiating fluid flow across the valve, the actuating member being so adapted whereby upon continued actuation during extension of the contact member the force acting upon the work piece through the agency of the contact member increases.

The valve is preferably resiliently biased to a closed position on a seating provided for this within the cylinder.

The actuating member may be in the form of a plunger moveable within the reservoir with a button as simple pressure pad thereon.

The plunger may conveniently be resiliently biased fluidly away from the valve.

The valve is advantageously a ball valve normally biased into a closed position by an open-coiled compression spring.

In one embodiment of the present invention the body of the device defines a single cylinder with the valve being interposed between the reservoir and the cylinder. The actuating member comprises a resiliently-biased plunger operable within the reservoir and carrying a stem contactable with the valve to selectively actuate the valve.

In said one embodiment the stem of the plunger is grooved for registration with the valve and the plunger is rotatable within the reservoir, rotation of the stem in use causing the valve to open to release pressure fluid from the cylinder into the reservoir thereby withdrawing the contact member. The plunger conveniently includes an externally protruding grip for rotation thereof by a user. A lever may be pivoted to the body of the device and is operable upon the actuating member to operate the same.

In another embodiment of the present invention the body of the device is elongate and defines first and second fluid-filled cylinders internally thereof, the cylinders being in opposition between ends of the body. A piston is moveable within each cylinder and each carries a contact member extending exteriorly from the respective cylinder for contact in use with a work piece. A resiliently biased valve is interposed between said reservoir and a respective cylinder for the control of fluid to and from the respective cylinder. A switching element is coupled to the actuating member to direct in use fluid flow from the reservoir to a respective cylinder. The actuating member comprises a resiliently-biased plunger operable within the reservoir. Each valve is conveniently in the form of a ball valve and is provided with a main spring and a secondary spring, the main spring being disposed within a respective cylinder and the secondary spring being located in opposition thereto, each said secondary spring being stronger than the corresponding main spring.

The switching element may be in the form of an apertured disc mounted on the actuating member in such manner as to selectively register with the reservoir to permit or prevent fluid flow across the disc to a selected cylinder.

In yet another embodiment of the present invention the valve is resiliently biased into an opened position, and the actuating member comprises a resiliently biased plunger. The valve is conveniently a ball valve provided with a main spring and a secondary spring, the main spring being disposed within the cylinder, and the secondary spring being located in opposition thereto and being stronger than the main spring.

In a further embodiment of the present invention again the body is of elongate form defining first and second fluid-filled cylinders internally thereof, the cylinders being in opposition between ends of the body. A piston is moveable within each cylinder and each piston carries a contact member extending exteriorly from the respective cylinder for contact in use with a work piece to be retained by the tool. The device comprises two reservoirs in communication with the respective cylinders, a resiliently biased valve being interposed between a respective reservoir and the corresponding cylinder for the control of fluid therebetween, and an actuating member associated with each reservoir for initiating fluid flow across the corresponding valve. Each actuating member comprises a resiliently-biased plunger operable within the corresponding reservoir. The actuating members are so adapted that upon actuation of one of said actuating members to initiate fluid flow across a respective valve into one cylinder to pressurize the same, depressurization of the other cylinder occurs. Each actuating member is preferably in the form of a plunger moveable within the reservoir and carries a stem for initiating actuation of the valve associated with said other cylinder.

Conveniently, in use, the movement of the actuating member causes an increase in fluid pressure in its respective reservoir thereby to open said valve of the respective cylinder to extend the corresponding piston and its respective contact member and simultaneously to effect contact of the stem with the other said valve to release fluid from the other said cylinder thus retracting the other said piston and its contact member.

The fluid used in all the embodiments is conveniently hydraulic oil.

According to another aspect of the present invention, there is provided an adjusting device for a hand-held tool, comprising:

- a body defining at least one fluid-filled cylinder formed internally thereof;
- a valve block in connection with said cylinder;
- a piston movable within said cylinder and carrying a contact member extending exteriorly from said cylinder;
- an articulated jaw connected to the contact member for contact in use with a work piece to be retained by the tool;
- a complementary jaw provided on the body at a corresponding end thereof for the clamping of the work piece with said articulated jaw;
- a resiliently-loaded valve associated with an interior end of said cylinder and mounted in the valve block for controlling the flow of hydraulic fluid therebetween; and
- an actuating member associated with the valve block for operating the valve to control fluid flow across the valve, the fluid being lockable within the cylinder such that in use the jaws are also locked onto the work piece.

Conveniently, the device includes a second fluid-filled cylinder, the valve block being interposed between said cylinders and having the flow of hydraulic fluid thereacross controlled by the corresponding resiliently-loaded valves, the actuating member being associated with the valve block simultaneously operating the valves to control fluid flow across the valves.

Typically, the articulated jaw is pivotally mounted on the respective body end, and preferably biased in the open position with the agency of a helical torsion spring, and in abutment contact with the respective contact member adjacent the body end. Alternatively, the articulated jaw is slidably connected to the respective contact member adjacent the body end.

According to a further aspect of the present invention, there is provided an adjusting device for a hand-held tool, comprising:

- a body defining two fluid-filled cylinders formed internally thereof;
- a valve block interposed between said cylinders;
- a piston movable within each said cylinder and each carrying a contact member extending exteriorly from respective said cylinder for contact in use with a work piece to be retained by the tool;
- a complementary jaw provided on the body at each end thereof for the clamping of the work piece with corresponding said contact member;
- a resiliently-loaded valve associated with each interior end of each cylinder and mounted in the valve block for controlling the flow of hydraulic fluid thereacross;
- an actuating member associated with the valve block for simultaneously operating the valves to control fluid flow across the valves, the fluid being lockable within the cylinders such that in use the jaws are also locked onto the work piece; and
- the actuating member including a rotor provided with a cam profile for contacting each of said valves and a grip member for operation of the rotor.

The valves are preferably resiliently biased to a closed position on a seating provided for this within the valve block, which is provided with suitable fluid passageways connecting with the relatively inner ends of the cylinders to provide intercommunication between the cylinders.

Each valve is advantageously a ball valve normally biased into a closed position by an open-coiled compression spring.

The rotor may conveniently be formed with a blade carrying the cam profiles on diametral edges thereof, such that the cam profiles are operable upon the valves in unison.

The rotor is advantageously provided with a barrel portion which locates within a cylindrical passage in the valve block, the barrel portion having suitable seals for engaging the wall of the passage. The passage may have stepped diameters and the rotor barrel may be correspondingly stepped.

The jaws are of the open-ended wrench type and of a desirable shape and size such as to accommodate the work piece to which the hand tool is to be applied. The articulated jaw is also pivotally mounted on the complementary jaw to give the requisite clamping action. The jaw mounted on the contact member may also be articulated at least one point.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE PREFERRED EMBODIMENTS

With reference to the annexed drawings the preferred embodiments of the present invention will be herein described for indicative purpose and by no means as of limitation.

Figure 1:
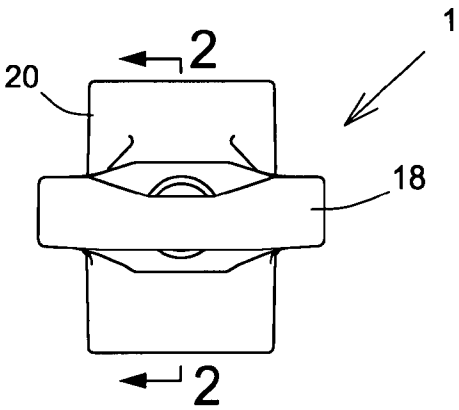
FIG. 1 is an end view of an adjusting device for a hand-held tool in accordance with a first embodiment of the present invention.
Figure 2:
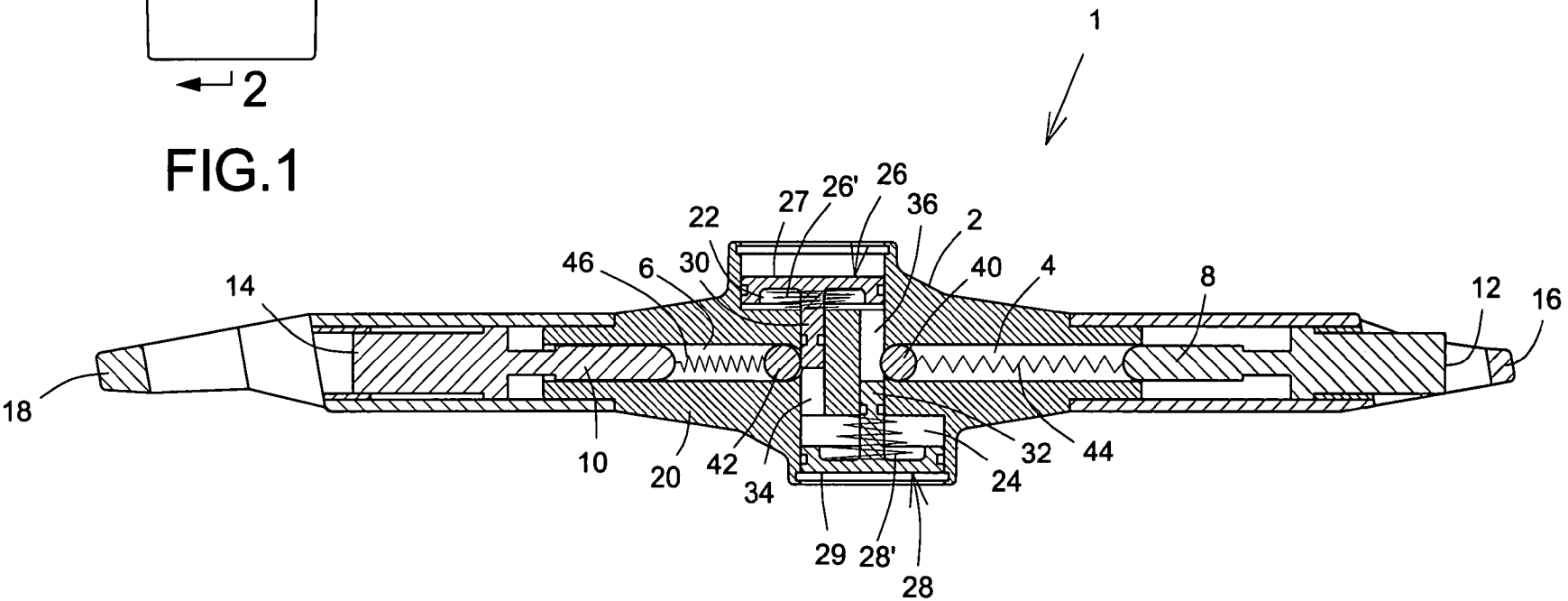
FIG. 2 is a sectional view taken along line 2-2 of FIG. 1.

Reference is now made to FIGS. 1 and 2. The adjusting hand tool device is shown generally at 1 and comprises a double-ended elongate body 2 defining therewithin two typically axially aligned (they could be angled without departing from the scope of the present invention) opposed cylinders 4, 6 within each of which is accommodated a respective piston 8, 10. The cylinders are typically filled with hydraulic oil. The piston 8, 10 each carry a contact member 12, 14 for contact with a work piece 3 (shown in dotted lines in FIG. 3), the members 12, 14 extending exteriorly of the body 2 as shown which has at each end a typically fixed ring 16, 18 for locating the work piece 3 in use.

Intermediate the cylinders 4, 6 is a control block 20 in which are formed two reservoirs 22, 24 each having an actuating member such as a spring-loaded plunger 26, 28 (with respective conical coil springs 26', 28' being shown) or the like respectively slidable therewithin in close fitting manner (sealed). Each plunger 26, 28 has a button-like head 27, 29. The plungers 26, 28 respectively carry stems 30, 32 which sealably slide within guide channels 34, 36 formed in the block to prevent fluid communication between the two reservoirs 22, 24 (including the corresponding channels 34, 36).

A ball valve 40, 42 is seated within the end of a respective cylinder 4, 6 and is resiliently loaded as by a spring 44, 46 extending between the respective piston 8, 10 and the valve 40, 42.

In operation of the first embodiment, one end ring 16 is located over a work piece 3 by a user and the relatively lower plunger 28 (as shown in the drawing) is depressed by the user the oil from the reservoir 24 to become pressurized and in so doing the ball valve 42 is lifted off its seating against the action of the spring 46 thus allowing the oil to enter the cylinder 6 to extend the contact member 14 into the ring space. At the same time the stem 32 of the plunger 28 contacts the opposite ball valve 40 to lift it from its seating thus allowing egress of oil from the cylinder 4 and releasing the contact member 12. At the same time the oil escaping from the cylinder 4 pushes the plunger 26 to a starting position within the respective reservoir 22. Furthermore, release of manual pressure from the plunger 28 allows the valve 42 to become reseated under the action of the spring 46, thus locking the contact member 14 onto the work piece. When the tool is to be released from its clamping position, the plunger 26 is actuated whereby its stem 30 contacts the valve 42 to push it off its seating to allow oil flow from the cylinder 6. At the same time oil is forced from the reservoir 22 into the guide channel 36 to release the valve 40 to allow oil flow into the cylinder 4.

Operation of the contact member 12 is the same mutatis mutandis as for the contact member 14.

It will be well understood that whilst a user continues to apply pressure to a plunger, the corresponding contact member continues to be increasingly pressurized.

Figure 3:
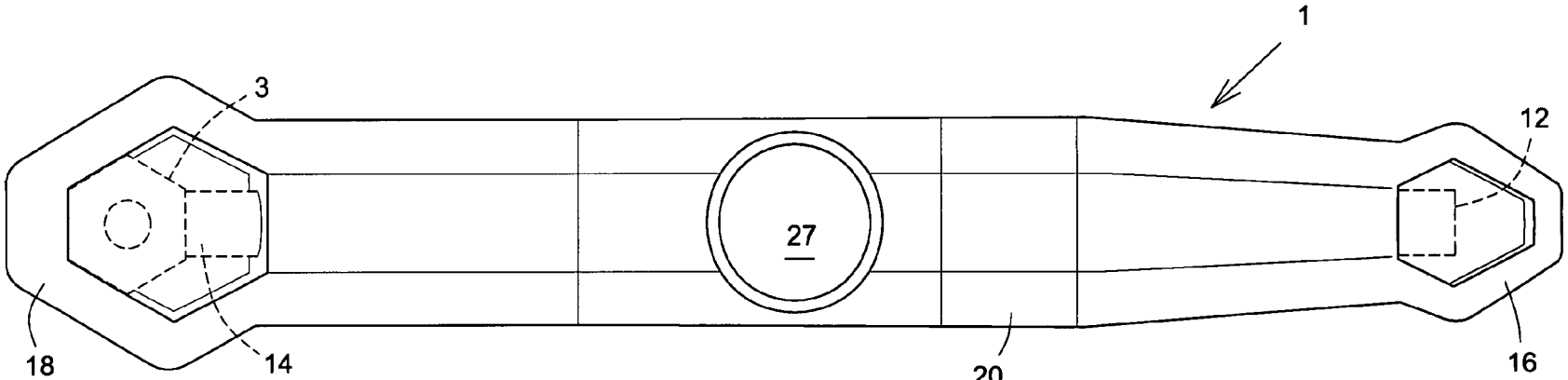
FIG. 3 is a plan view of a second embodiment.
Figure 3A:
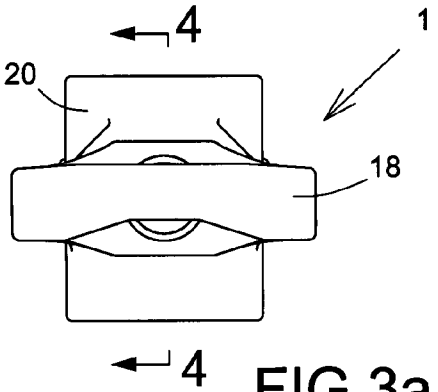
FIG. 3*a* is an end view of the device of FIG. 3.
Figure 4:
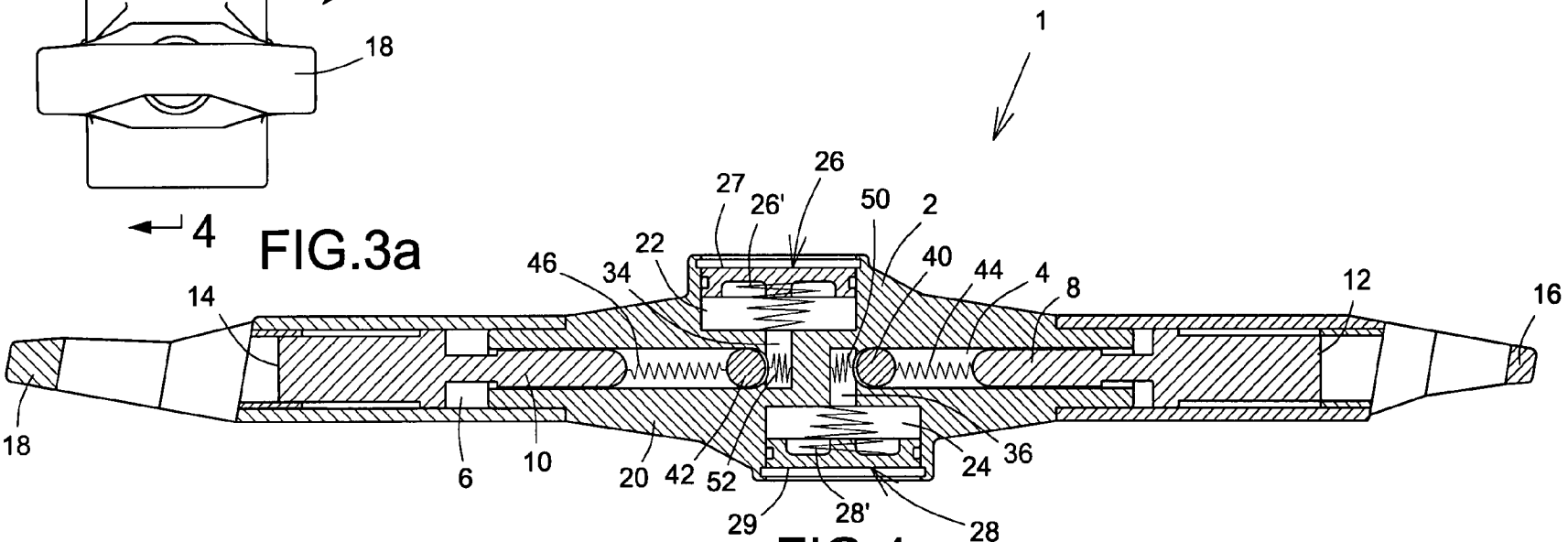
FIG. 4 is a sectional view taken along line 4-4 of FIG. 3*a;*

Referring now to FIGS. 3, 3*a* and 4, a second embodiment of adjusting hand tool device is shown and this embodiment differs from the first embodiment by providing a differently formed control block 20, which again defines separate reservoirs 22, 24 with respective plungers 26, 28 that are not provided with any stems. The reservoirs 22, 24 have channels 34, 36 each leading separately to the cylinders 4, 6 via the valves 40, 42. In this embodiment there is provided for each ball valve a secondary spring 50, 52 accommodated in respective channels 34, 36 opposed to the main springs 44, 46. All other features of this embodiment correspond to those of the first embodiment and are not described specifically again.

In this second embodiment, when it is desired to apply clamping pressure to a work piece 3 registering within one of the rings 16, 18 the appropriate plunger 26, 28 is operated to push oil from the reservoir 22, 24 into the fluid-filled cylinder 4, 6 and initiate displacement of the contact member 12, 14. Once the member 12, 14 contacts the work piece, the user stops depressing the plunger 26, 28 and starts rotating the tool around the work piece to pressurize the oil in the respective reservoir 22, 24. With the increasing pressure within the relevant cylinder, the ball valve reseats under the action of the oil pressure to lock the oil within the cylinder. However, once pressure on the work piece is removed the secondary spring

50, 52, which is of greater strength than the main spring 44, 46, overcomes the resistance of the main spring and lifts the valve 40, 42 off its seating to allow back flow of the oil into the reservoir 22, 24.

In this second embodiment, the contact members and their respective active components operate independently of each other.

Figure 6A:
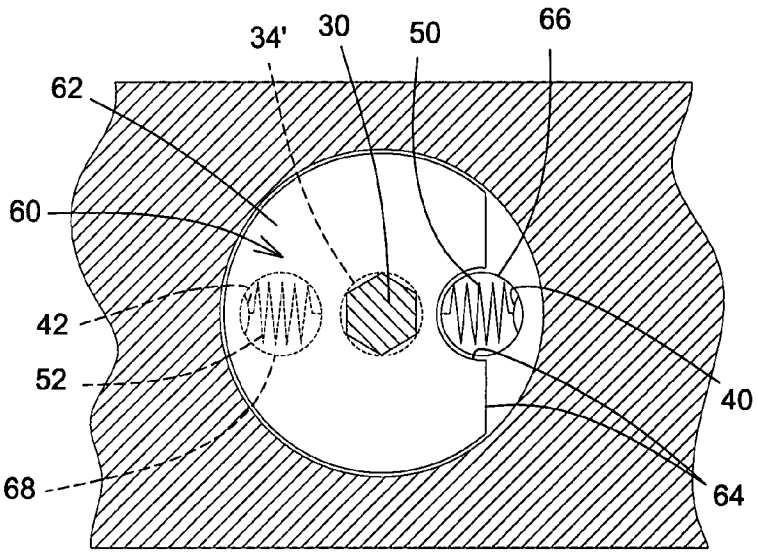
FIG. 6*a* is a partially broken enlarged sectional view taken along line 6*a*-6*a* of FIG. 6.
Figure 6:
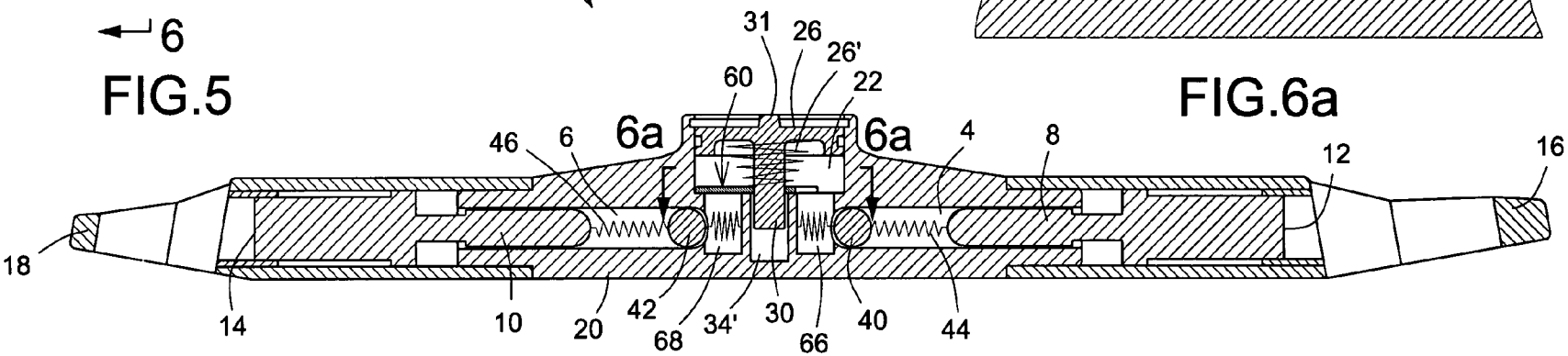
FIG. 6 is a sectional view taken along line 6-6 of FIG. 5.
Figure 5:
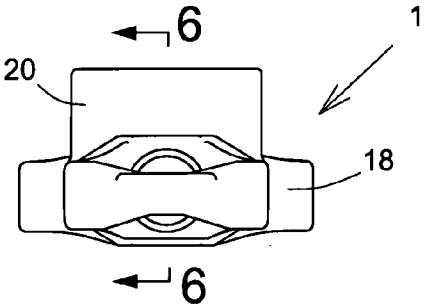
FIG. 5 is an end view of a third embodiment.

Referring now to FIGS. 5, 6 and 6*a*, a third embodiment of an adjusting hand tool device comprises similar features to those shown in FIGS. 3, 3*a* and 4 with the exception of the control block 20 which houses a single reservoir 20 with its associated spring-loaded plunger 26 which carries a stem 30 of hexagonal cross section (any other non-circular shape could obviously be considered without departing from the scope of the present invention) as can be seen more distinctly in FIG. 6*a*, and is rotatably moveable within the generally cylindrical guide bore 34'. A selector element in the form of a disc 60 sealably engages on the stem 30 and is provided with blanking zone 62 and a cut-out 64 which latter is shown in FIGS. 6 and 6*a* registering with a bore 66 extending from the reservoir 22 and opening into the end of the cylinder 4, a similar bore 68, shown as being blocked by the disc 60, also extends from the reservoir 22 to open into the end of the cylinder 6. The ball valves 40, 42 are spring-loaded on opposite sides as with the previous embodiment, with the secondary springs 50, 52 located within the respective bore 66, 68.

In operation of this embodiment with the orientation of the disc 60 as depicted, downward pressure of the plunger 26 causes oil to flow from the reservoir 20 into the bore 66 and thence past valve 40 into the cylinder 4 to extend the piston 8 and thus the contact member 12 into a clamping mode. As with the previous embodiment as the pressure on the contact member reduces upon releasing the work piece 3 so does the oil pressure inside the cylinder 4 and the secondary spring 50 causes the valve 40 to unseat and allow retraction of the piston 8 and the contact member 12. The backflow of oil resets the plunger 26, with the help of the plunger spring 26'. When it is desired to use the other contact member 14, the plunger 26 is rotated, using an externally protruding and generally diametrically extending grip 31, to bring the cut-out 64 into registration with bore 68 leading to the cylinder 6 while sealably blocking the bore 66. The actuation of the plunger 26 is now capable of pressurizing the cylinder 6 to operate the piston 10 and the contact member 14 carried thereby.

Figure 8A:
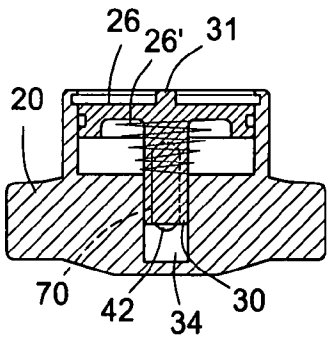
FIG. 8*a* is a sectional view taken along line 8*a*-8*a* of FIG. 8.
Figure 8:
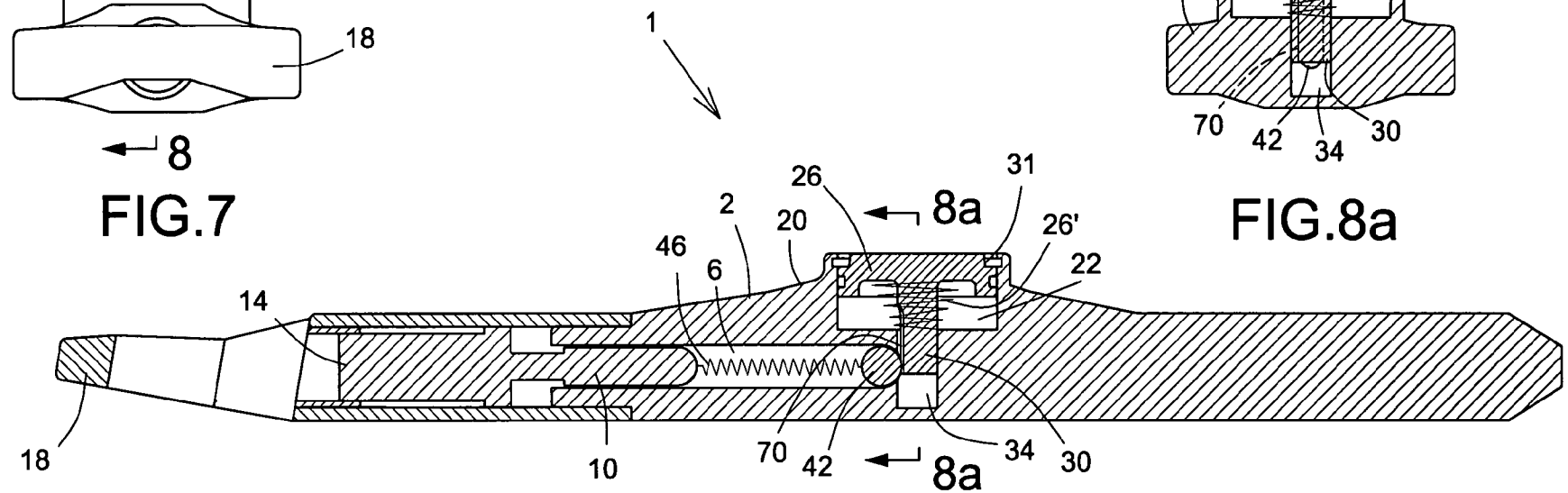
FIG. 8 is a sectional view taken along line 8-8 of FIG. 7.
Figure 7:
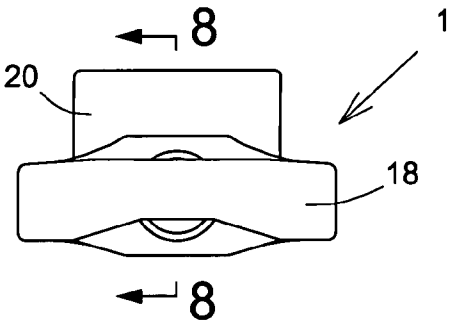
FIG. 7 is an end view of a fourth embodiment.

Referring now to FIGS. 7, 8, and 8*a*, the adjusting hand tool device of this fourth embodiment has but a single cylinder 6 formed within the body 2 and has a single reservoir 20 with the spring-loaded plunger 26 slidably operable therewithin. The plunger carries a stem 30 moveable within the associated guide channel 34, the stem 30 having a groove 70 formed therein for clearing the ball valve 42 which partly extends into the channel 34 as shown and to allow the oil to flow between the reservoir 22 and the cylinder 6 via the channel 34. When it is required to operate the hand tool device, the plunger 26, with the groove 70 in register with the valve 42, is depressed to expel oil from the reservoir 20 into the groove 70 and past the valve 42 into the cylinder 6 to extend the contact member 14 into the ring 18. Continuing pressure on the plunger 26 increases pressure on the piston. Release of the plunger allows the pressurized oil in the cylinder 6 and the spring 46 to reseat the valve 42 and lock the tool device in its clamping mode. When it is desired to release the device, the plunger is rotated using the grip 31 thus causing the stem 30, the walls of the groove 70, to move the ball valve 42 off its seat to allow backflow of oil into the reservoir 22.

Figure 9:
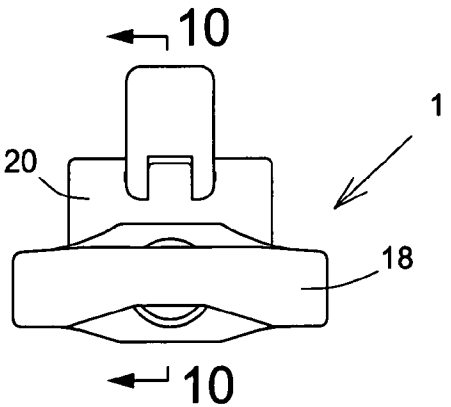
FIG. 9 is an end view of a modified fourth embodiment.
Figure 10:
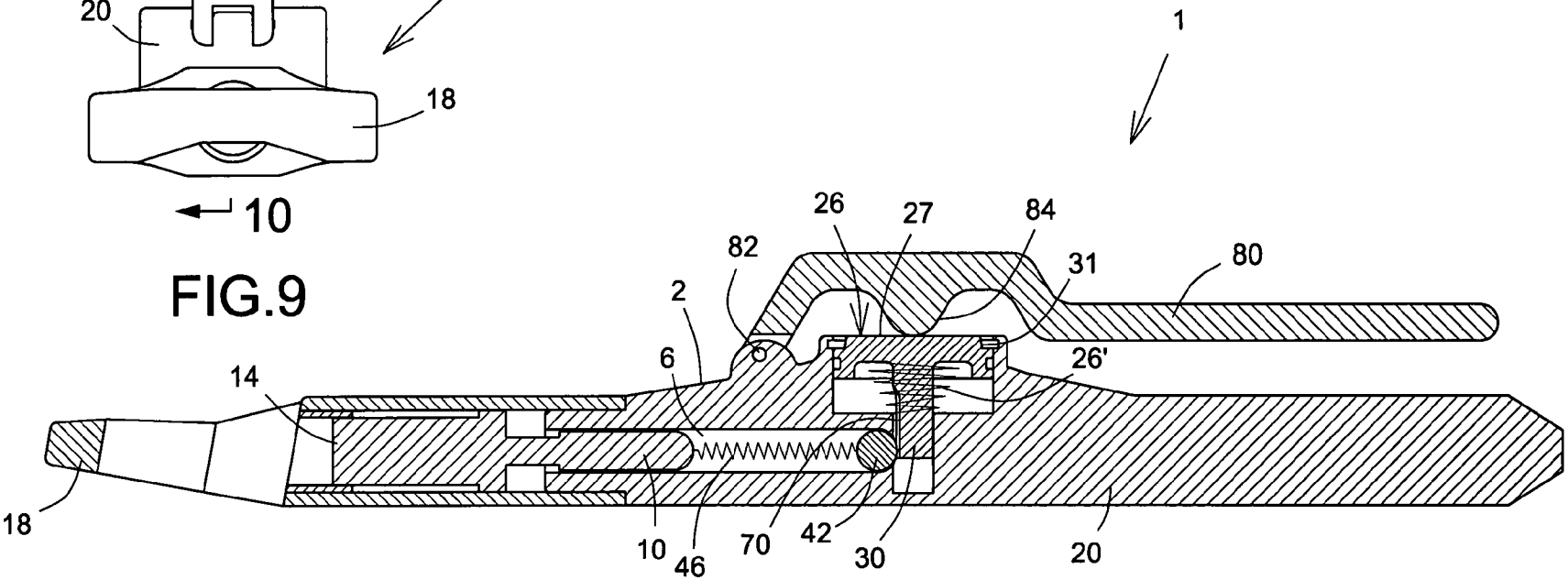
FIG. 10 is a sectional view taken along line 10-10 of FIG. 9.
Figure 11:
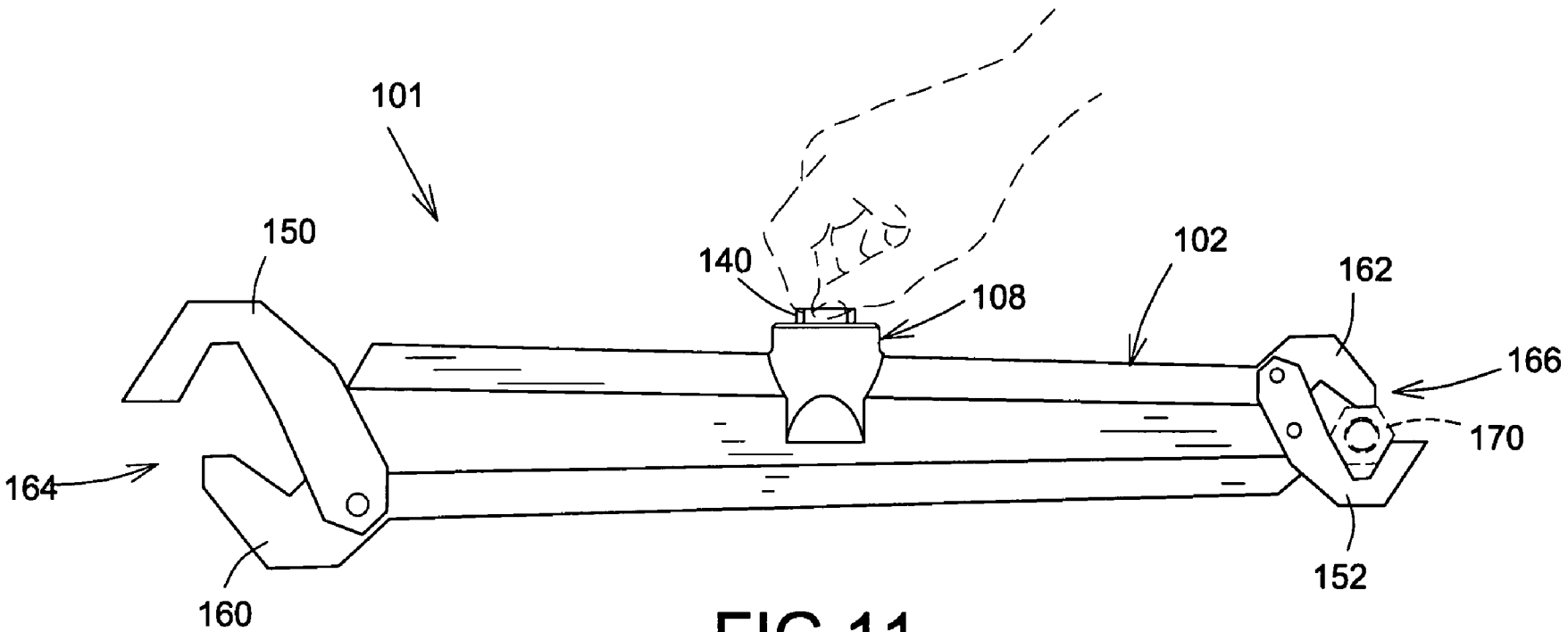
FIG. 11 is a simplified top view of an open-ended wrench in accordance with another embodiment of the present invention.
Figure 11A:
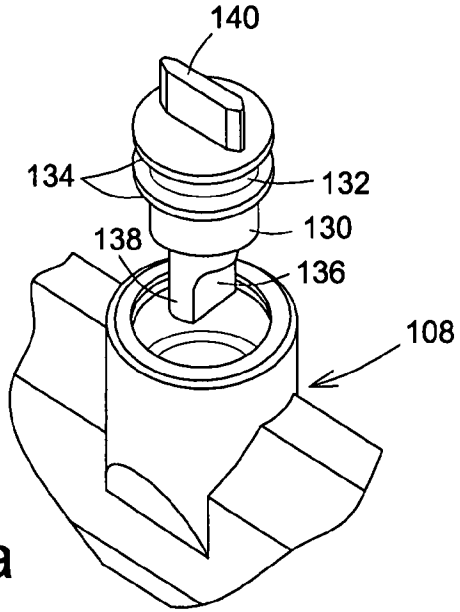
FIG. 11*a* is an exploded view of a detail shown in FIG. 11
Figure 12:
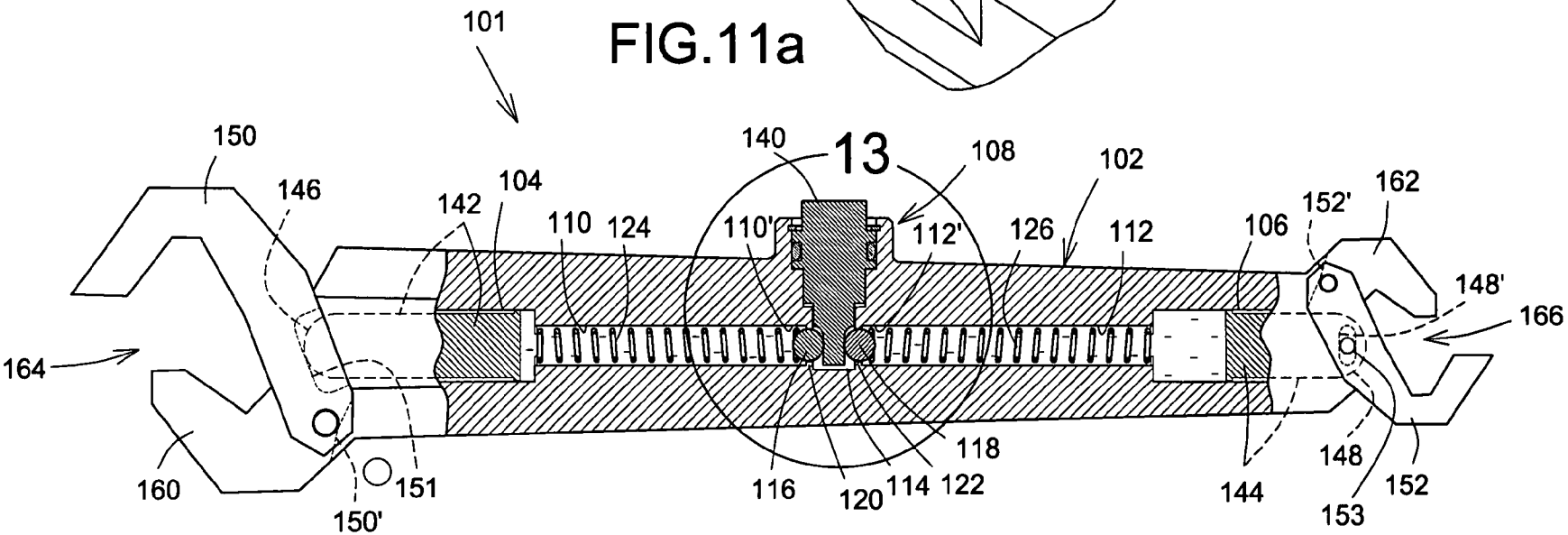
FIG. 12 is a simplified longitudinal section of the wrench showing an adjusting device with a valve block of the embodiment of FIG. 11.

Turning now to FIGS. 9 and 10, there is shown a modified version of the fourth embodiment in which a lever 80 is hinged at 82 to the body 2 to provide a pivot, the lever having a protuberance 84 for contacting the grip 31 of the button-like head 27 of the plunger 26. The provision of the lever 80 affords greater pressure to be applied to the plunger 26. Release of the pressure in the cylinder is again effected by rotating the plunger to move the valve off its seating.

It is to be understood that with all embodiments of the present invention continued operation of the plunger(s) causes increased clamping pressure on the contact member.

Referring now to FIGS. 11 to 14, there is illustrated an adjusting device for a hand-held tool 101 comprising a body 102 defining internally thereof two longitudinally aligned cylinders 104, 106 interconnected through typically aligned fluid passages 110, 112 respectively formed in a central valve block 108 defining a valve chamber 114 situated between the passages 110, 112. The relatively inner ends 110', 112' of the passages 110, 112, and cylinders 104, 106, provide seats 120, 122 for diametrically opposed ball valves 116, 118. The ball valves 116, 118 are spring-loaded into their respective seats 120, 122, via biasing members 124, 126, such as compression coil springs or the like. Although the two cylinders 104, 106 are shown as longitudinally aligned, they could be angled relative to each other without departing from the scope of the present invention, as illustrated in U.S. Pat. No. 6,973,857 for example.

The valve chamber 114 is generally cylindrical and has stepped diameters for receiving in rotatable fashion a rotor 130 of correspondingly stepped diametral form. A top sealing recess 132, formed into the rotor 30 and defined by annular sealing lips 134 is provided in the chamber 114 to receiving a typical O-ring seal member 133 or the like for positive sealing there through. Typically, a C-clip spring member 135 (see FIG. 13*a*) is used to axially retain the rotor 130 into the chamber 114.

The rotor 130 has at one end thereof a cam blade 136 provided on its diametral edges cam formations 138 for contacting the ball valves 116, 118 for a purpose to be described hereinafter. At the other end of the rotor 130 remote from the cam blade 136 is a grip member 140, such as a thumbscrew or the like, for facilitating in use manual rotation of the rotor 130.

A piston 142, 144 is provided for each cylinder 104, 106 and each carries a contact member 146, 148. As shown respectively in left and right hand sides of FIGS. 11 and 12, contact member 146 is connected in abutment contact with an articulated jaw 150 inside a corresponding recess 151 thereof, while contact member 148 alternatively pivotally and slidably connects to an articulated jaw 152 with a slot hole 148' of the contact member 148 receiving a corresponding pin member 153 of the jaw 152. Although the two jaws 150, 152 are shown with different contacting configurations relative to their corresponding contact members 146, 148 for the purpose of illustration, the same configuration could obviously be used at both ends of the tool 101. Both jaws 150, 152 are typically pivotally mounted on the respective end of the body 102, and are preferably connected using helical torsion springs 150', 152' or the like, schematically represented in dotted lines in FIG. 12, to help disengaging the tool from the work piece and keep the jaw 150 in contact with the contacting member 146 when required. Jaws 150, 152 typically have a shape conforming to that conventionally adopted in open ended wrenches. A complementary jaw 160, 162 is mounted on a respective end 164, 166 of the body 102 such that in use a nut 170 or other work piece (see FIG. 11) may be located as shown between the jaws to be clamped therebetween. Alternatively, at least one of the jaws 150, 152 could directly be the contact member 146, 148 to clamp the nut 170 with the corresponding complementary jaw 160, 162 that would therefore extend in front of and spaced from the respective contact member 146, 148.

The passages 110, 112, the lower part of the chamber 114 intersecting the passages, and the cylinders 104, 106 are filled with hydraulic oil.

Figure 13:
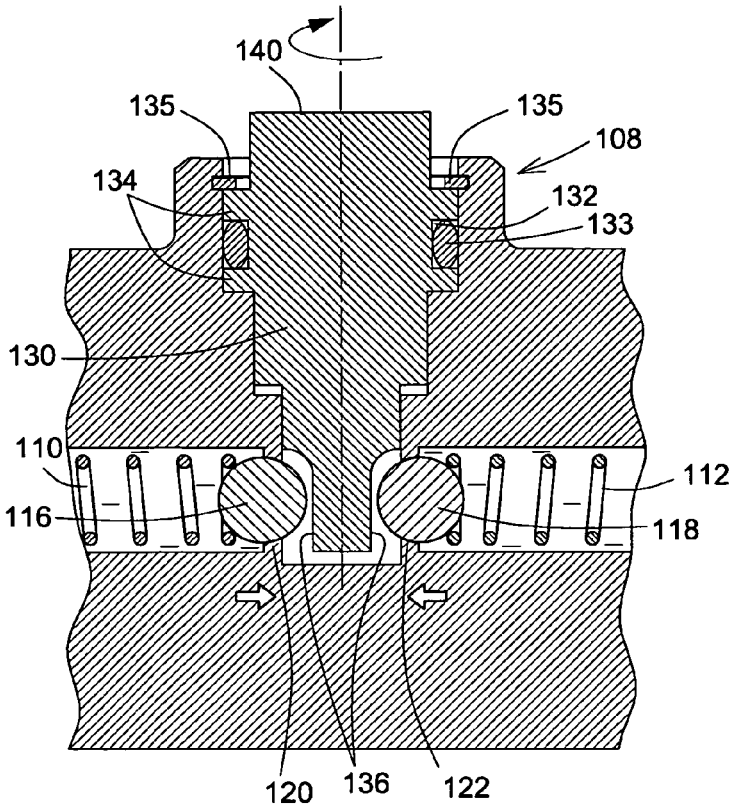
FIG. 13 is an enlarged section view taken along line 13 of FIG. 12, showing the locking member in a locked configuration.
Figure 13A:
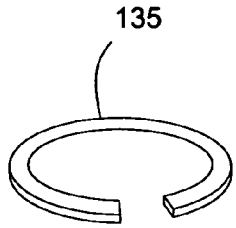
FIG. 13*a* is an enlarged perspective view, showing the C-clip member of the embodiment of FIG. 11.
Figure 14:
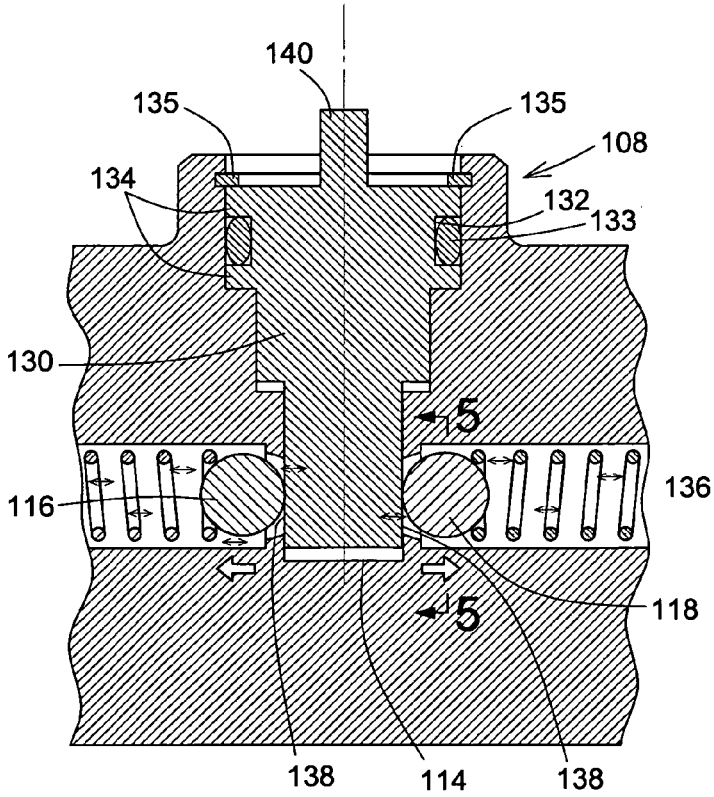
FIG. 14 is an enlarged section view similar to FIG. 13, showing the locking member in an adjusting configuration.
Figure 15:
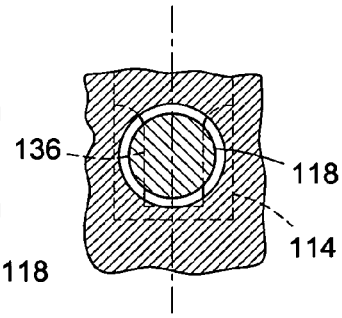
FIG. 15 is a cross section view taken along line 15-15 of FIG. 14.

In use, when it is desired to locate the hand tool over a work piece such as a nut 170, the thumbscrew 140 on the rotor 130 is turned to simultaneously bring the cam formations 138 into contact with the ball valves 116, 118 off their seats 120, 122 (FIG. 14) against their spring loading thus allowing a through fluid flow between the passages 110, 112 and the cylinders 104, 106. With one end of the tool being located over the nut 170 between the jaws 152 and 162, the contact member 146, or the corresponding articulated jaw 150, at the other end of the tool is pushed inwardly, or opened, to move the piston 142 towards the valve block thus forcing fluid into the cylinder 106 to move the piston 144 to articulate the jaw 152 to clamp onto the nut 170. When the clamping action has been executed, the rotor 130 is rotated such as to simultaneously release the ball valves 116, 118 into their closed position to lock the hydraulic fluid in the respective cylinders 104, 106 (FIG. 13). When the hand tool is to be removed from the nut 170, the thumbscrew 140 is turned to rotate the rotor 130 to allow fluid interconnection to simultaneously release the hydraulic lock at which time the jaw 152 may be articulated manually into a release position.

The jaws 150, 152, and 160, 162 may be of various profiles and sizes dependent upon the specific uses and the way the work piece 170 needs to be held, the jaws 150, 152 being interchangeable. Similarly, the different shapes of the corresponding articulated and complementary jaws 150, 160 (and 152, 162) could vary, or simply be interchanged, depending on the specific needs. Typically, the relative positions of the corresponding articulated and complementary jaws 150, 160 (and 152, 162) are determined in function of an average size of the work piece 170 to ensure proper clamping therewith.

The adoption of the rotor 130 with the thumbscrew actuator confers upon the tool a positive action in the absence of a likelihood of sticking in use.

Figure 16:
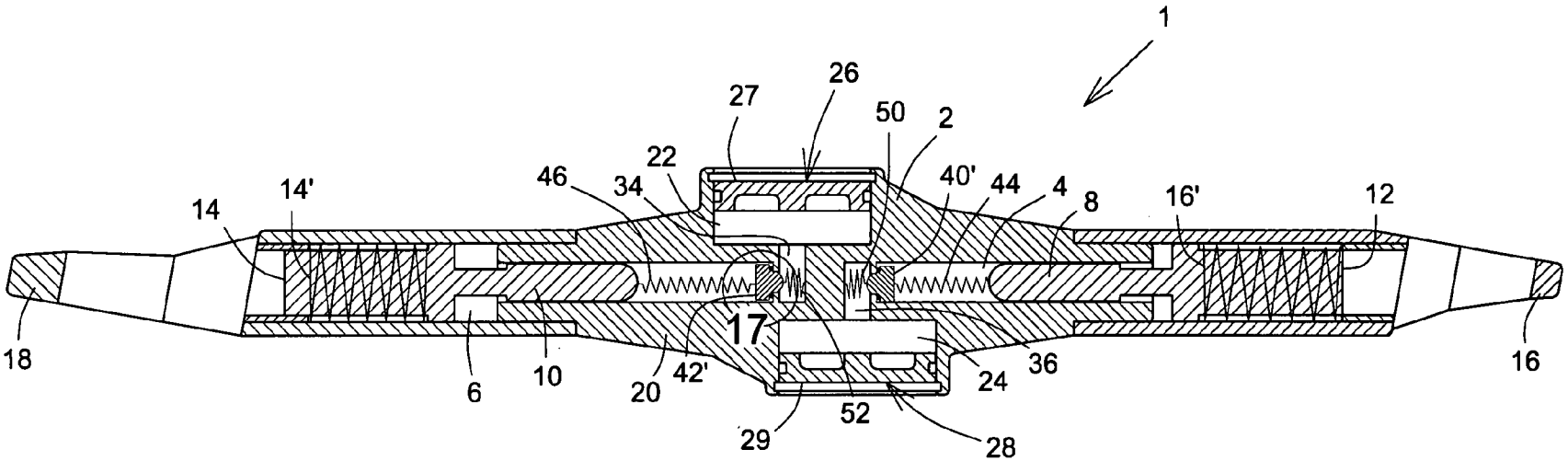
FIG. 16 is a view similar to FIG. 4, showing another embodiment of an adjusting tool.
Figure 17:
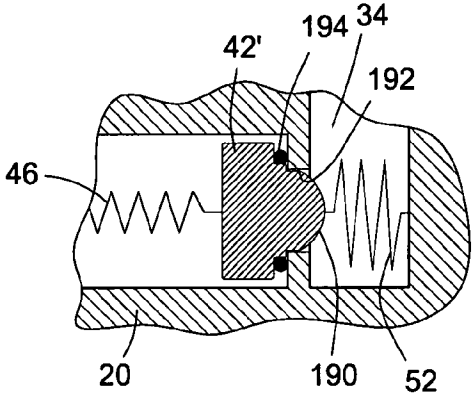
FIG. 17 is an enlarged section view taken along line 17 of FIG. 16.

Although the different embodiments are shown with different components throughout FIGS. 1 to 15, some of these components may be made differently. FIGS. 16 and 17 show some of these different components. More specifically, instead of having biasing conical coil springs 26', 28' associated with respective plungers 26, 28, these springs 26', 28' could be replaced by respective contact member biasing springs 14', 16' between the respective contact member 14, 16 and the body 2 of the tool device 1 to perform the same functions. Also, as shown in FIG. 17, the ball valves 40, 42 with their respective seating are easily replaced by plugs 40', 42' each having a typically rounded (to simulate the same function as the ball when interfacing the stems 30, 32 or secondary springs 50, 52, whenever required) guided end 190 axially engaging a corresponding through opening 192 between the cylinders 4, 6 and the channels 36, 34, and an o-ring seal 194 surrounds the guided end 190 as a collar to prevent oil from flowing through the opening 192 whenever required to close the valve.

Although not shown throughout the figures, it would be obvious to one skilled in the art that any push-type plunger 26, 28, instead of being sealed with a typical o-ring, could typically include a rigid central portion (as a large head nail or the like) surrounded by a semi-flexible rubber and/or plastic type skirt secured to the body 2, and that any o-ring seal instead of being positioned in a corresponding groove located on moving part (such as a stem, plunger or the like) could be positioned in a groove located on the fixed part (such as the body) without deviating from the scope of the present invention. In fact, having the groove on the fixed part may prove to be more efficient, to offer less friction resistance and to increase the robustness of the tool device 1.

Depending on the specific embodiment, the above-described alternatives may be more attractive for a manufacturing and/or reliability point of view. Similarly, although biasing coil springs are illustrated throughout the figures, any other type of biasing mechanism, such as resilient plastic and/or rubber based materials and the like, could obviously be used without deviating from the scope of the present invention.

The above-described jaws of the open-ended wrench type, including different configurations and shapes thereof, can also obviously be used on the hand tool device 1 of FIGS. 1 to 10, and 16, with the contact member(s) connecting to the articulated jaw(s), without deviating from the scope of the present invention, with such hand tool device that may look and operate like pliers or the like.

While specific embodiments of the adjusting device for hand-held tools of the present invention have been described, those skilled in the art will recognize many alterations that could be made within the spirit of the invention. The description provided herein is provided only for purposes of illustration, and not for purposes of limitation.

I claim:

1. An adjusting device for a hand-held tool comprising:

a body defining at least one fluid-filled cylinder internally thereof;

a piston movable within said cylinder and carrying a contact member extending exteriorly from the cylinder for contact in use with a work piece to be retained by the tool;

a fluid reservoir in communication with said cylinder;

a valve being resiliently biased and interposed between said reservoir and the cylinder for the control of fluid to and from the cylinder; and an actuating member associated with the fluid reservoir for initiating fluid flow across the valve, the actuating member including a resiliently-biased plunger operable within the reservoir and carrying a stem contactable with the valve to selectively actuate said valve, the actuating member being so adapted whereby upon continued actuation during extension of the contact member the force acting upon the work piece through the agency of the contact member increases, the stem of the plunger being grooved for registration with the valve and the plunger is rotatable within the reservoir, rotation of the stem in use causing the valve to open to release pressure fluid from the cylinder into the reservoir thereby withdrawing the contact member.

2. An adjusting device for a hand-held tool as claimed in claim 1, wherein the valve is resiliently biased into a closed position on a seating provided for this purpose within the cylinder.

3. An adjusting device for a hand-held tool as claimed in claim 1, wherein the plunger is resiliently biased fluidly away from the valve.

4. An adjusting device for a hand-held tool as claimed in claim 1, wherein the valve is a ball valve.

5. An adjusting device for a hand-held tool as claimed in claim 1, wherein the plunger includes an externally protruding grip for rotation thereof by a user.

6. An adjusting device for a hand-held tool as claimed in claim 1, wherein a lever is pivoted to the body and is operable upon the actuating member to operate the same.

7. An adjusting device for a hand-held tool as claimed in claim 1, wherein the valve is a plug-type valve including a plug and an o-ring seal.

8. An adjusting device for a hand-held tool comprising:

an elongate body defining first and second fluid-filled cylinders internally thereof, the cylinders being in opposition between ends of the body;

a piston moveable within each said cylinder and carrying a contact member extending exteriorly from the respective cylinder for contact in use with a work piece;

a fluid reservoir in communication with said cylinders;

a resiliently biased valve interposed between said reservoir and a each said cylinder for the control of fluid to and from the respective said cylinder;

an actuating member associated with the fluid reservoir for initiating fluid flow across the valve, the actuating member being so adapted whereby upon continued actuation during extension of the contact member the force acting upon the work piece through the agency of the contact member increases; and a switching element coupled to the actuating member to direct in use fluid flow from the reservoir to a respective said cylinder and the actuating member comprising a resiliently-biased plunger operable within the reservoir.

9. An adjusting device for a hand-held tool as claimed in claim 8, wherein each valve is a ball valve and is provided with a main and a secondary spring, the main spring being disposed within a respective cylinder and the secondary spring being located in opposition thereto, each said secondary spring being stronger than the corresponding main spring.

10. An adjusting device for a hand-held tool as claimed in claim 8, wherein the switching element is in the form of an apertured disc and is mounted on the actuating member in such manner as to selectively register with the reservoir to permit or prevent fluid flow across the disc to a selected cylinder.

11. An adjusting device for a hand-held tool as claimed in claim 8, wherein the plunger includes an externally protruding grip for rotation thereof by a user.

12. An adjusting device for a hand-held tool comprising:

a body defining at least one fluid-filled cylinder internally thereof;

a piston movable within said cylinder and carrying a contact member extending exteriorly from the cylinder for contact in use with a work piece to be retained by the tool;

a fluid reservoir in communication with said cylinder;

a valve interposed between said reservoir and the cylinder for the control of fluid to and from the cylinder, the valve being a ball valve and being provided with a main and a secondary spring, the main spring being disposed within the cylinder, and the secondary spring being located in opposition thereto and being stronger than the main spring to bias the valve into an opened position; and an actuating member associated with the fluid reservoir for initiating fluid flow across the valve, the actuating member being so adapted whereby upon continued actuation during extension of the contact member the force acting upon the work piece through the agency of the contact member increases, and the actuating member including a resiliently-biased plunger operable within the reservoir.

13. An adjusting device for a hand-held tool comprising:

an elongate body defining first and second fluid-filled cylinders internally thereof, the cylinders being in opposition between ends of the body;

a piston movable within each said cylinder and carrying a contact member extending exteriorly from the respective cylinder for contact in use with a work piece to be retained by the tool;

a fluid reservoir in communication with each said cylinder;

a resiliently biased valve being interposed between a respective said reservoir and the corresponding said cylinder for the control of fluid therebetween; and an actuating member associated with each reservoir for initiating fluid flow across the corresponding valve, each actuating member comprising a resiliently-biased plunger operable within the corresponding reservoir; the actuating members being further so adapted that upon actuation of one of said actuating members to initiate fluid flow across a respective valve into one said cylinder to pressurize the same, depressurization of the other said cylinder occurs.

14. An adjusting device for a hand-held tool as claimed in claim 13, wherein each actuating member is in the form of a plunger moveable within the reservoir and carries a stem for initiating actuation of the valve associated with said other cylinder.

15. An adjusting device for a hand-held tool as claimed in claim 14, wherein in use the movement of the actuating member causes an increase in fluid pressure in its respective reservoir thereby to open said valve of the respective cylinder to extend the corresponding piston and its respective contact member and simultaneously to effect contact of the stem with the other said valve to release fluid from the other said cylinder thus retracting the other said piston and its contact member.

* * * * *